United States Patent [19]

Balinski

[11] 3,943,680

[45] Mar. 16, 1976

[54] STUD HAVING KERF-ENGAGING FLANGE AND FIRE-RETARDANT WALL STRUCTURE FORMED THEREWITH

[75] Inventor: Henry A. Balinski, Hoffman Estates, Ill.

[73] Assignee: United States Gypsum Company, Chicago, Ill.

[22] Filed: May 27, 1975

[21] Appl. No.: 580,995

[52] U.S. Cl. ..... 52/481; 52/496; 52/729; 52/738

[51] Int. Cl.[2] ..... E04B 2/30; E04B 2/78

[58] Field of Search ..... 52/354–356, 52/481–484, 495–497, 729, 735, 738, 492, 715, 241, 730, 731, 732

[56] References Cited

UNITED STATES PATENTS

| | | | |
|---|---|---|---|
| 979,644 | 12/1910 | Burson | 52/354 |
| 2,007,618 | 7/1935 | Smead | 52/732 X |
| 2,381,635 | 8/1945 | Baker | 52/241 |
| 3,271,920 | 9/1966 | Downing, Jr. | 52/481 |
| 3,327,444 | 6/1967 | Downing, Jr. | 52/732 |
| 3,609,933 | 10/1971 | Jahn et al. | 52/481 |
| 3,702,044 | 11/1972 | Balinski | 52/481 |
| 3,839,839 | 10/1974 | Tillisch et al. | 52/481 |

FOREIGN PATENTS OR APPLICATIONS

| | | | |
|---|---|---|---|
| 902,721 | 8/1962 | United Kingdom | 52/731 |

*Primary Examiner*—Alfred C. Perham
*Attorney, Agent, or Firm*—Samuel Kurlandsky; Stanton T. Hadley; Donnie Rudd

[57] ABSTRACT

A unitary integral metal stud formed of sheet metal for constructing a fire-retardant wall and the wall structure formed of a plurality of studs and a pair of spaced-apart layers of gypsum wallboard panels in abutting relationship, the stud comprising a web having a pair of flanges defining a wallboard panel-engaging channel on one side, and a kerf-engaging flange substantially centrally locatead on the other side, and means extending from the web and having a supporting surface adapted to have a second layer of gypsum wallboard panels affixed thereto. A first row of panels is engaged by the channel and kerf-engaging flange, whereas a second layer of gypsum wallboard panels is affixed to the supporting surface extending from the roof. Additionally apertures may be provided in the web to inhibit heat conduction through the metal stud, and additionally to provide space into which the edges of the wallboard panels may dissipate heat if they should become hot, as for example during a fire. The resultant wall structure formed of the studs has a superior fire-rating.

9 Claims, 4 Drawing Figures

STUD HAVING KERF-ENGAGING FLANGE AND FIRE-RETARDANT WALL STRUCTURE FORMED THEREWITH

BACKGROUND OF THE INVENTION

1. Field of Invention

The present invention relates to wall constructions, and more particularly refers to studs which may be utilized to form fire-retardant or fire-rated wall structures particularly for use in enclosing open shafts in multi-story buildings such as offices and high-rise apartments, and to the wall structures formed therewith.

2. Description of the Prior Art

Walls enclosing shafts such as air return shafts, elevator shafts, and stairwell shafts commonly separate the shafts from other rooms such as corridors, toilets, and utility rooms. With increasing governmental concern for promoting safety for occupants of public buildings, manufacturers of building products have sought to provide shaft walls meeting at least minimal safety requirements, while at the same time, providing builders with materials that are both easy to install and low in cost.

Two of the most important of these safety requirements concern wind loading and fire ratings. Destructive wind loading is of particular concern where the shaft is an air return shaft or an elevator shaft, where pressures or vacuums are developed which load the shaft wall up to 15 pounds per square foot in excess of atmospheric pressure.

Cavity walls, and particularly those utilized for enclosing elevator shafts, stairwells, and air return shafts, are continually being subjected to increasingly stringent fire code requirements. The trend is to require such walls to meet or surpass certain fire ratings measured pursuant to ASTM E-119 Fire Rating Test. Elevator shaft walls require, for example, at least a 2-hour rating. Where the wall system is "unbalanced," increasingly, code enforcement organizations are requiring that the rating be achieved from both sides of the wall. To pass such tests, each transfer through the metal studs used to construct such walls must be substantially reduced. At the same time, however, the stud must still retain a sufficient degree of structural strength, and in addition, must meet economic requirements. Moreover, the engagement of the stud with the wall panels which they support must be of such nature that construction is achieved with a minimum of required labor and materials. The structure must, nevertheless, withstand the requirements of accurate and complete engagement of the panels and studs, to ensure that the fire rating will be achieved.

The above fire problems concerning shafts can also be said to apply to long corridors in buildings, which in effect are horizontal, rather than vertical, shafts. Thus, without adequate fire ratings, a corridor wall easily transmits the fire throughout the floor as the fire proceeds along the corridor.

To solve these and other problems, early building shaft walls were commonly built up and lined with various types of block masonary, including both concrete and gypsum block. While block masonary has proved suitable for many applications, it has been found to be undesirable in those situations where the shaft rises to great heights. Further, block masonry structures cannot withstand high wind loading. Because of their great weight, concrete block masonry materials require supporting structures of great weight and strength. An additional problem is that these heavy materials give rise to problems in their installation. Those skilled in installing the above-described shaft lining materials are forced to handle them at dangerously high levels.

Walls of the type described and related structures have been disclosed in the prior art, and particularly in U.S. Pat. Nos. 3,740,912, 3,702,044, 3,609,933, 3,016,116, 3,094,197, 999,752, 3,495,417, 3,271,920, 3,839,839, and many others. However, even though many of the structures disclosed in these patents have proven to be highly satisfactory, the search has continued to provide wall structures of the type described of greater strength, and greater fire-retardant properties.

SUMMARY OF THE INVENTION

It is accordingly, an object of the invention to provide a stud for the construction of a cavity shaft wall for multi-story buildings, which meets safety standards of wind loading, and to provide a wall formed of a plurality of the studs.

It is a further object to provide a stud for the construction of a cavity shaft wall, which wall can meet required fire-rating tests.

It is an additional object to provide a stud for the production of a cavity shaft wall which is relatively inexpensive, lightweight, and relatively easy to install.

Other objects and advantages will become apparent upon reference to the drawings and detailed description.

According to the invention, a metal stud is provided for forming a fire-rated wall formed of a plurality of wall panels disposed to form two spaced-apart rows with each of the panels having two opposed vertical edges, and a plurality of studs interposed between and mounting the panels. Each of the studs comprises a web having a pair of flanges at the edges thereof cooperating to define a channel adapted to engage the edge of a wallboard panel, and a kerf-engaging flange arranged medially on the other side of the web adapted to engage the kerf of an adjacent wallboard panel. Additionally, a wallboard supporting panel arranged to support another layer of panels is provided on the stud spaced-apart from the web. In constructing a wall, a plurality of studs are positioned in upper and lower runners. Then a first layer of liner panels is engaged at each stud on one side of the web by the channel and on the other side of the web by a kerf-engaging flange disposed within the kerf in the edge of the adjacent panel. A second layer of wallboard panels is affixed to the wallboard supporting panels of the stud to form a fire-rated wall. The resulting wall structure is able to pass required fire-rating tests in both directions, as for example, under ASTM E-119.

DESCRIPTION OF THE PREFERRED EMBODIMENTS

Figure 1:
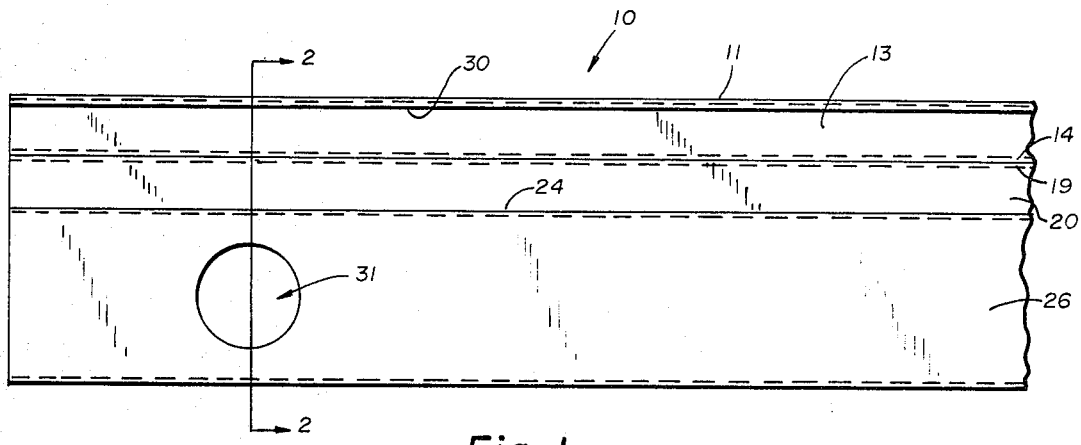
FIG. 1 is a side elevational view of a stud according to the invention.
Figure 2:
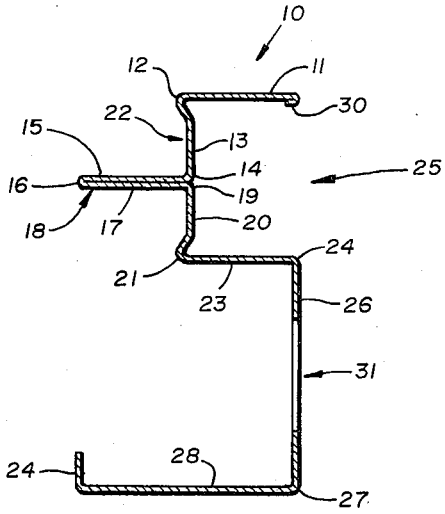
FIG. 2 is a cross-sectional view taken at the line 2—2 of FIG. 1, looking in the direction of the arrows.

Referring to FIGS. 1 and 2, a stud 10 is shown comprising a first flange 11 extending to a first fold 12, a first web member 13 connected to the first fold 12 and extending perpendicularly to the first flange 11 to a second fold 14. A first kerf-engaging flange member 15 is connected at the second fold and extends perpendicularly to the first web member 13 to a third fold 16. A second kerf-engaging flange member 17 is connected to the third fold 16 and is folded over on the first kerf-engaging flange member 16, continuing to a fourth fold 19, the kerf-engaging flange members 15 and 17 cooperating to define a kerf-engaging flange 18. A second web member 20 is connected at the fourth fold 19 and extends substantially perpendicularly to the flange 18 to a fifth fold 21. The first web member 13 and the second web member 20 cooperate to define a web 22. A second flange 23 is connected at the fifth fold 21 and extends substantially perpendicularly to the web member 20 to a sixth fold 24. The first flange 11, the second flange 23, and the web 22 combine to define a panel-engaging channel 25.

The means for supporting a second layer of panels spaced apart from the first layer comprises a supporting web 26 connected at the sixth fold 24 and extending away from the channel 25 to a seventh fold 27. A wallboard-supporting panel 28 is connected at the seventh fold 27 and extends substantially parallel to the flanges 11 and 23. A turned over edge or flange 29 may be provided to increase the rigidity of the structure. Additionally, a turned-over flange lip 30 may be provided on the flange 11 to increase rigidity. Apertures 31 are provided in the supporting web 26 to permit transit of cables, ducts, or wires.

Figure 3:
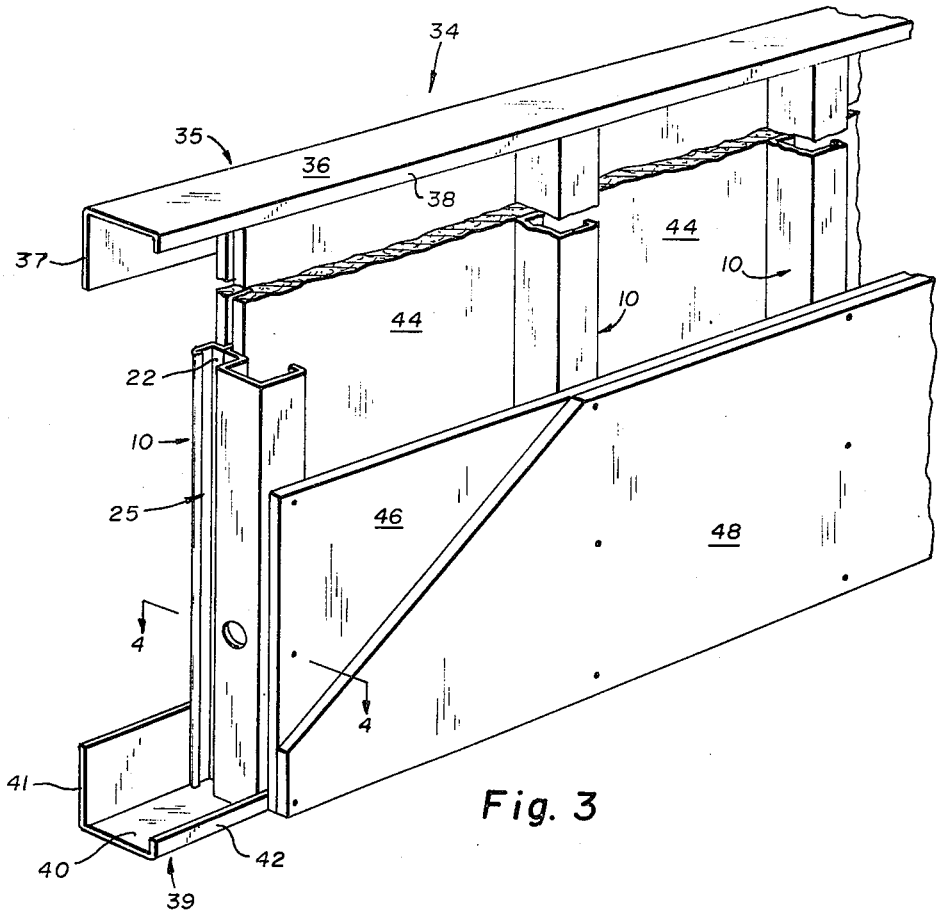
FIG. 3 is a perspective view of a portion of a cavity shaft wall employing studs such as shown in FIGS. 1 and 2.
Figure 4:
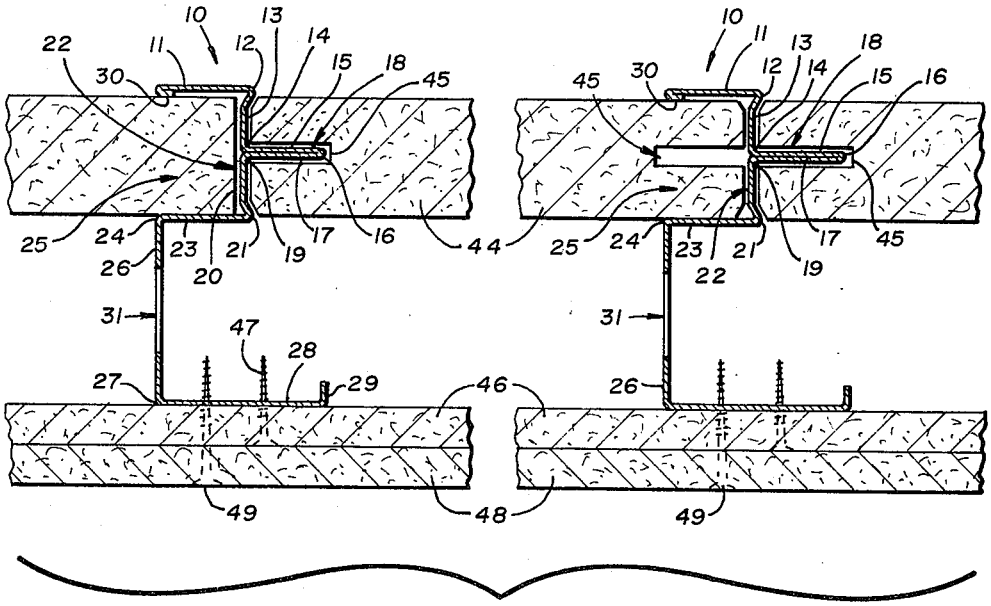
FIG. 4 is a cross-section of the wall taken at the line 4—4 of FIG. 3, looking in the direction of the arrows.

Referring to FIGS. 3 and 4, a wall structure 34 is shown utilizing a plurality of studs 10. The structure is in the form of a cavity shaft wall structure suitable for assembly from the outer or corridor side with respect to the cavity around which the wall is assembled, and comprises an upper J-runner 35 having a web 36, a major or large flange 37 on the shaft side and a minor or smaller flange 38 on the outer or corridor wall side. The runner 35 may be affixed to a ceiling structure. On the floor structure is mounted a lower J-runner 39 having a web 40, a major flange 41 on the shaft side and a minor flange 42 on the outer or corridor side. A plurality of studs 10 having a structure as shown in FIGS. 1 and 2 are mounted inside the runners 35 and 39. As shown in FIGS. 3 and 4, a layer or row of gypsum wallboard or liner panels 44 is retained at one edge within the channels 25 of each stud and restrained in three directions by the web 22 and the flanges 11 and 23. At the other edges the liner panels 44 are provided with kerfs 45 engaged by the kerf-engaging flanges 18. A first outer layer of wallboard panels 46 is affixed to the wallboard-supporting panels 28 of each stud by means of screws 47. A second layer of outer wallboard panels 48 is affixed to the first layer of panels 46 and the studs 10 by means of screws 49.

In erecting the wall, because of the structure of the J-runners and studs, the entire wall may be assembled from the outside or corridor side of the shaft without the need for placing workmen on scaffolding within the shaft to assemble any portion of the wall from the shaft side. In assembling the wall the runners 35 and 39 are first affixed to the ceiling and floor structures. A stud 10 is then inserted between the flanges of the runners and maintained in place by the flanges, which flanges may be screwed to the runners. A wallboard panel 31 is then set into place with its bottom edge against the lower runner, and the upper edge is swung into place into the upper runner. The minor flange 38 of the runner 35 is sufficiently narrow so that the upper edge of the wallboard panel clears the flange and comes to rest against the major flange 37. It can then be moved laterally to become engaged within the channel 25. A second stud is then mounted between the runners and moved laterally until the kerf-engaging flange 16 is inserted within and engages the kerf 45 of the wallboard panel. Successive panels are engaged either by the kerf-engaging flanges 18 or the channels 25. The liner panels then are screwed to the panels 28 of the studs, and a wall structure results which has excellent fire-resisting properties.

It is to be understood that the invention is not to be limited to the exact details of operation or structure shown and described in the specification and drawings, since obvious modifications and equivalents will be readily apparent to one skilled in the art.

What is claimed is:

1. A stud adapted for use in constructing a wall comprised of a pair of spaced-apart coplanar layers of gypsum wallboard panels in abutting relationship having a plurality of said studs interposed between said layers of wallboard panels and affixed thereto, said stud being formed of a unitary integral sheet metal structure and comprising:

1. A first wallboard panel layer-engaging structure comprising;
   - a. a first flange extending to a first fold,
   - b. a web member connected at said first fold and extending substantially perpendicularly with respect to said first flange to a second fold,
   - c. a first kerf-engaging flange member connected at said second fold and extending substantially perpendicularly with respect to said first web member to a third fold,
   - d. a second kerf-engaging flange connected at said third fold and folded over said first kerf-engaging flange and extending to a fourth fold,
   - e. a second web member connected at said fourth fold and extending substantially perpendicularly with respect to said second kerf-engaging flange to a fifth fold, and
   - f. a second flange connected at said fifth fold and disposed substantially perpendicular to said second web member and extending to a sixth fold, said first and second web members cooperating to define a web, said web and said first and second flanges cooperating to define a channel adapted to engage the edge of a wallboard panel of a first layer, and said first and second kerf-engaging flanges cooperating to define a kerf-engaging flange adapted to engage an adjacent wallboard panel of said first layer and cooperating with said web to restrain said panel in three directions, and, 2. means for supporting a second layer of gypsum wallboard panels spaced apart from said first layer of panels comprising:
   - a. a supporting web connected at said sixth fold and extending away from said second flange and terminating at a seventh fold, and b. a wallboard-supporting panel connected at said seventh fold extending in a direction substantially parallel to and spaced-apart from said first and second flanges, said panel being adapted to permit said second layer of panels to extend across and be affixed to the outer surface thereof.

2. A stud according to claim 1, wherein a flange is provided on said wallboard-supporting panel to increase structural rigidity.

3. A stud according to claim 1, having apertures provided in said supporting web to permit passage of conduits, wires and pipes.

4. A fire-retardant wall comprising in combination:

A. upper and lower runners

B. a plurality of studs mounted in said runners, each of said studs comprising:

1. a first wallboard panel layer-engaging structure comprising:

a. a first flange extending to a first fold, b. a web member connected at said first fold and extending substantially perpendicularly with respect to said first flange to a second fold, c. a first kerf-engaging flange member connected at said second fold and extending substantially perpendicularly with respect to said first web member to a third fold, d. a second kerf-engaging flange connected at said third fold and folded over said first kerf-engaging flange and extending to a fourth fold, e. a second web member connected at said fourth fold and extending substantially perpendicularly with respect to said second kerf-engaging flange to a fifth fold, and f. a second flange connected at said fifth fold and disposed substantially perpendicular with respect to said second web member and extending to a sixth fold, said first and second web members cooperating to define a web, said web and said first and second flanges cooperating to define a channel adapted to engage the edge of a wallboard panel of a first layer, and said first and second kerf-engaging flanges cooperating to define a kerf-engaging flange adapted to engage an adjacent wallboard panel of said first layer and cooperating with said web to restrain said panel in three directions, and,

2. means for supporting a second layer of gypsum wallboard panels spaced apart from said first layer of panels comprising:

a. a supporting web connected at said sixth fold and extending away from said second flange and terminating at a seventh fold, and b. a wallboard-supporting panel connected at said seventh fold extending in a direction substantially parallel to and spaced-apart from said first and second flanges, C. a first row of gypsum wallboard panels, the edges on one side of said panels being engaged and retained within the channels of said studs, and the opposite edges of said panels being provided with kerfs and having the kerf-engaging flanges of said studs engaged therein, and D. a second row of gypsum wallboard panels engaged by and affixed to said wallboard-supporting panels in substantially parallel spaced-apart relationship with respect to said first row.

5. A wall according to claim 4, wherein a third layer of gypsum wallboard panels is affixed to said second layer of wallboard panels.

6. A wall according to claim 4, wherein a third layer of gypsum wallboard panels is affixed to said first layer of wallboard panels.

7. A wall according to claim 4, wherein a flange is provided on the wallboard-supporting panel of each stud to increase structural rigidity.

8. A wall according to claim 4, wherein apertures are provided in the supporting web of each stud to permit passage of conduits, wire and pipes.

9. A wall according to claim 4, wherein the corners of the vertical edges of said panels of said first layer are beveled to facilitate their insertion into said channels.

* * * * *